US005603416A

United States Patent [19]

Richardson et al.

[11] Patent Number: 5,603,416

[45] Date of Patent: Feb. 18, 1997

[54] SECURE PNEUMATIC TOOL DISPLAY

[75] Inventors: Brian Richardson, West Harrison; Daniel Sanchez, Forest Park, both of Ohio

[73] Assignee: Campbell Hausfeld/Scott Fetzer Co., Westlake, Ohio

[21] Appl. No.: 531,523

[22] Filed: Sep. 21, 1995

[51] Int. Cl.[6] ..... A47F 5/00

[52] U.S. Cl. ..... 211/70.6; 211/4; 248/551; 70/15; 70/61

[58] Field of Search ..... 248/551; 211/4, 211/70.6; 70/15, 18, 58, 61

[56] References Cited

U.S. PATENT DOCUMENTS

| | | | |
|---|---|---|---|
| 3,664,163 | 5/1972 | Foote | 248/551 X |
| 4,120,401 | 10/1978 | Newman | 206/566 |
| 4,171,559 | 10/1979 | Vyse et al. | 29/407 |
| 4,212,175 | 7/1980 | Zakow | 70/58 |
| 4,452,361 | 6/1984 | Harris | 211/70.6 |
| 4,472,952 | 9/1984 | Hollowell | 70/61 |
| 5,002,251 | 3/1991 | Kranenberg | 248/551 X |
| 5,119,649 | 6/1992 | Spence | 70/58 X |
| 5,124,685 | 6/1992 | Rankin | 340/568 |
| 5,291,765 | 3/1994 | Hoisington | 70/18 X |

*Primary Examiner*—Robert W. Gibson, Jr.
*Attorney, Agent, or Firm*—Wood, Herron and Evans, P.L.L.

[57] ABSTRACT

A secure tool display includes a quick-connect pneumatic coupling and a cable extending therethrough. A cable stop limits withdrawal of the cable from a first coupling fitting mounted on the tool. The other end of the cable is attached to the display unit. When the coupling is connected, the tool is statically mounted and displayed. When the fittings or components of the coupling are detached, the tool can be lifted off the display unit and manipulated, but not removed therefrom beyond the length of the cable.

5 Claims, 1 Drawing Sheet

SECURE PNEUMATIC TOOL DISPLAY

BACKGROUND OF THE INVENTION

1. Field of the Invention

The present invention relates to display devices for pneumatic tools and, more particularly, to the secure display of pneumatic tools.

2. Description of the Prior Art

Pneumatic tools are generally used by professional mechanics and tradesmen. The users of these tools find that the weight, balance, and "feel" of the tools are very important. When purchasing pneumatic tools, it is preferable that the purchaser be able to test the tool for this "feel". Due to the value of these pneumatic tools, the samples are generally kept locked in display cases so that store employees may supervise the testing of the tools. This, of course, requires the constant presence of sales personnel at the point of display.

To reduce pilferage and to allow customers to test the tools without requiring the supervision of a sales person, an unobtrusive security device is required. To date, there are no known pneumatic tool security devices which allow customers to test the "feel" of the tool while, at the same time, keeping the tool secure, in a vertical and very visable position.

U.S. Pat. No. 4,452,361 describes one prior pneumatic rack for holding pneumatic tools which have male air coupler nipples. The tool rack has a plurality of studs capped by female couplers for receiving the male air coupler nipples of the pneumatic tools. The pneumatic tools are not secured to the tool rack of the prior art, but are merely removably mounted there. Once the tools are lifted away from the rack coupler, it can be transported anywhere. While this patent illustrates a useful way to display tools, it does not solve the security and pilferage problems noted above.

Security devices for deterring pilferage of displayed articles, other than pneumatic tools are known. In some devices, a cable is attached to the article and to an immovable support. These devices may include spring-loaded rotatable reels and guide means for retracting the cable toward the support when the article is replaced on the support. It is also known to provide an anchor cable securing an article such as a gun to a display mechanism while permitting inspection, testing and movement of the article. To secure rings to a jewelry display to prevent pilferage, yet to allow customers to try on the rings, it is known to connect a line to the ring such as that when the ring is removed from the jewelry display, the line is fed out through a slot for a predetermined distance. The line is coupled to a reel such that when the ring is replaced in the slot of the display case, the line is taken up.

None of the known prior art suggests how a pneumatic tool can be effectively secured while yet displaying the tool on a quick-connect coupler.

It is thus one objective of the present invention to provide for the securing of pneumatic tools to a display in orderly fashion so the tools cannot be removed from the area, yet while also allowing dismounting and manipulation of the tool by a prospective purchase at the point of display.

SUMMARY OF THE INVENTION

To these ends, the present invention contemplates a secure pneumatic tool display device constructed so that the tool may be accessibly displayed, while reducing pilferage. The display device includes a display support surface, a male connector nipple secured to the pneumatic tool, a female coupler securely attached to the display surface, and a cable extending through the nipple and the coupler and secured beneath the display surface. The cable end at the nipple is formed so the nipple (and attached tool) cannot be pulled away from the cable. Nevertheless, the tool and nipple can be lifted from the coupler for handling and manipulation conducive to a sale, with the cable holding the tool securely but flexibly in the area of the display. The display surface of the tool rack is preferably constructed to be approximately waist high for the convenience of the customers.

In one embodiment of the invention, the female coupler is manufactured without the normal internal valve, allowing the cable to be fed through the central axis of the female coupler. The female coupler is attached to a first end of a male/male connector, thereby securing the female coupler to the display surface. An adaptor may subsequently be screwed onto the second end of the male/male connector to improve the security and stability of the device. A cable having a prefabricated copper stop is fed through the male nipple connector, the female coupler, the hole in the display surface, the male/male connector and the adaptor. The lower end of the cable may then be secured to the bottom of the display surface by means of staples, nails or the like, or the cable may be crimped with a connector device to form a loop such that the diameter of the connector is larger than the internal diameter of the adaptor, thereby securing the pneumatic tool to the display surface.

In a second embodiment of the invention, a male or female connector is secured to an air tool, such as a spray gun, and the security cable is fed through the female connector through a hole in the display surface and secured to the underside of the display surface.

The present invention provides a secure connection between the pneumatic tool and a display surface, such as that the tool may be inspected but cannot be removed from the area of the display.

DRAWINGS

DETAILED DESCRIPTION OF THE INVENTION

Figure 1:
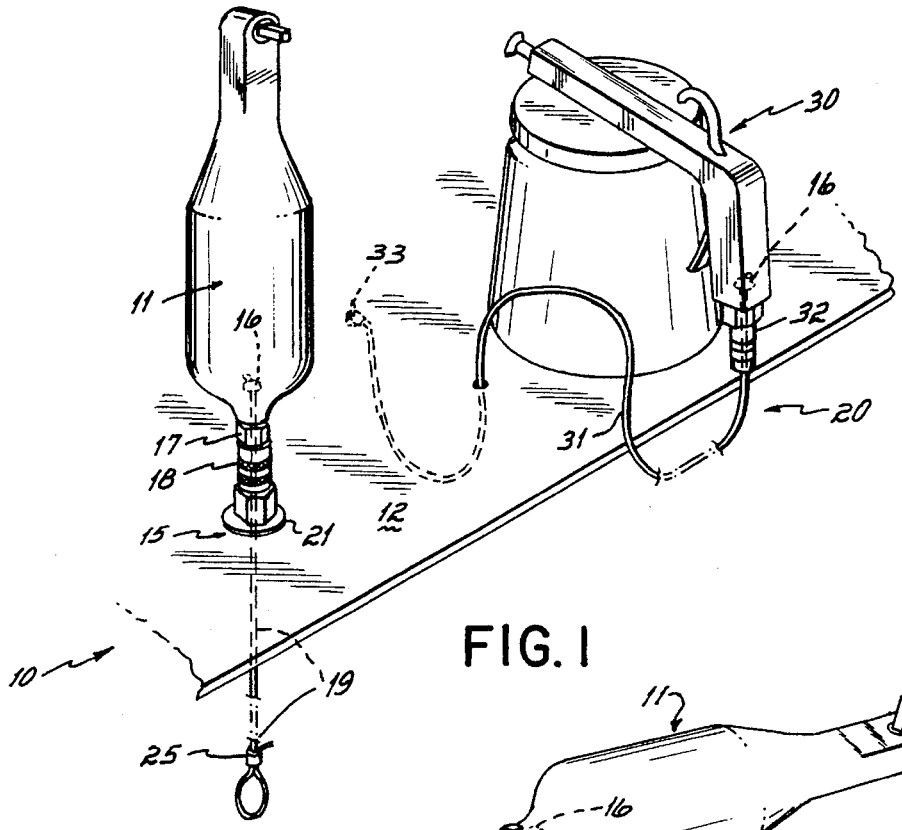
FIG. 1 is a perspective view of the display device showing several tools secured to the display surface.

Referring to the drawing, wherein like numerals represent like parts throughout the views, an air tool display rack 10 is shown in FIG. 1. The display rack 10 mounts pneumatic tools 11 and 30, which form no part of the present invention, on top of a display surface 12. The pneumatic tools 11 and 30 are secured to the display surface by security cable assemblies 15 and 20. The security cable assembly 15 retains the pneumatic tool 11 by way of a stop 16, preferably formed of copper. The free end of the cable is fed through a male nipple connector 17 which is then screwed into the pneumatic tool 11. The male nipple connector 17 may be removably engaged with the female coupler 18 to display the pneumatic tool in an orderly manner. Both a pneumatic tool 11 secured to the display rack 10 by the first embodiment of the present invention and a spray gun 30 secured to the display rack 10 by the second embodiment of the present invention are shown in FIG. 1.

In the first embodiment of the present invention, the pneumatic tool 11 is secured to the display rack 10 by engaging the air male nipple 17 with the female coupler 18 which is secured to a display surface 12. In FIG. 1 the pneumatic tool 11 is an air-driven ratchet secured to the display surface 12 by the security cable assembly 15.

Figure 2:
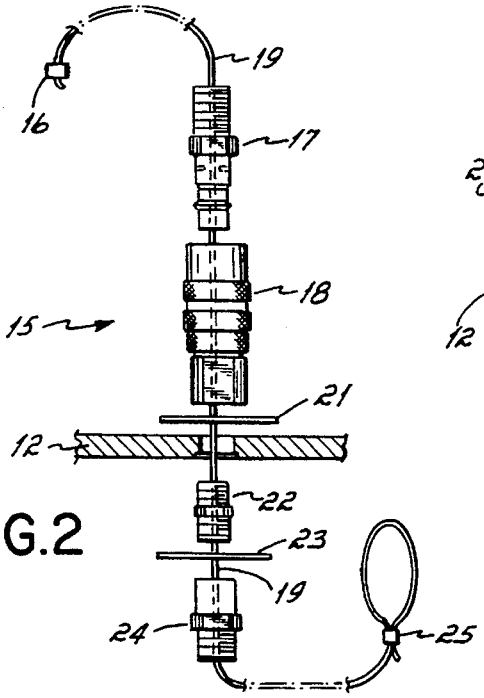
FIG. 2 is an exploded view of the first embodiment of the present invention.
Figure 3:
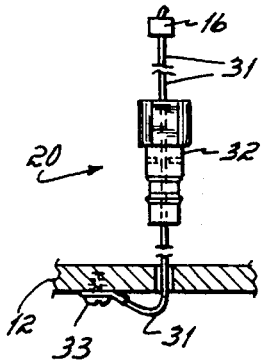
FIG. 3 is an exploded view of the second embodiment of the present invention.

FIG. 2 illustrates the assembly 15 in disassembled relationship. The security cable assembly 15 includes the stop 16, such as a crimp-on sleeve, preferably of copper, secured to a first or distal end of a security cable 20. The second end of the security cable 20 penetrates or extends through the male nipple connector 17, coupler 18, an upper reinforcing washer 21, the display surface 12, a male/male connector 22, a lower reinforcing washer 23, and a female adaptor 24. The security cable 20 is then doubled back and secured with a cable connector 25, preferably of aluminum, having a diameter larger than the internal diameter of the female adaptor. The length of the cable between stop 16 and connector 25 or other means for attaching the near end of the cable to the display, defines and limits the distance the tool can be moved from the display unit. The male nipple connector 17 of various pneumatic tools may be removably engaged with the female coupler 18 to display pneumatic tool 11 in an orderly manner.

It will also be appreciated that the stop 16 can take many forms such as a crimp-on sleeve, a knot, a ferrule, a clamp or some other means to add an enlargement to the cable, and to prevent it from pulling out from the connector fitting on the tool.

It will also be appreciated that many forms of readily available, quick-connect, pneumatic couplings can be used in connection with the invention. It is only necessary that the distal end of the cable be provided with a stop or crimp enlarged larger than a bore in the tool fitting through which the cable extends. It is also necessary to extend the cable through the coupler components. The display end of the cable through the female coupler must be also enlarged so as to be held by the coupler or otherwise attached to the display. Of course, the positions of the male and female could be reversed on the tool and shelf respectively, so long as the distal cable end cannot be pulled through the coupler element on the tool, and the other end can be secured to the display.

Figure 1A:
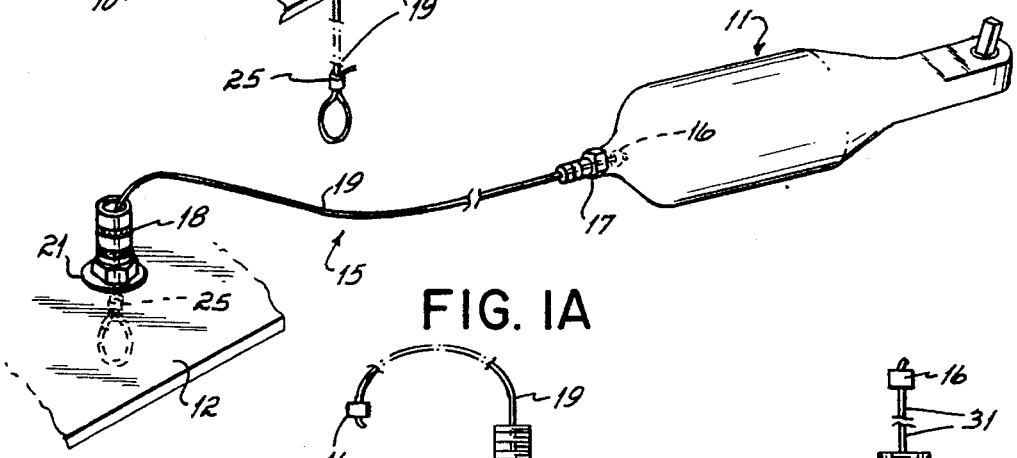
FIG. 1A is a view similar to FIG. 1 but showing one tool disconnected from the display for manipulation according to the invention.

FIG. 1A shows the limited removal of a tool 11 from the display unit 10. In this figure, fitting 17 has been disconnected from fitting 18 to prevent lifting the tool 11 off rack 10 so it can be held or manipulated as if in use, within the confining length of the cable.

Cable 20 prevents tool 11 from being moved away from display unit 10 beyond the length of cable 20. Stop 16 engages an abutment in fitting 17, while connection 25 on the other end of the cable is fixed to unit 10. Thus the tool can be moved, but only a distance away from unit 10 generally defined by the length of cable between stop 16 and feature 25 thereon.

In the second embodiment of the present invention, a self-supporting pneumatic device, such as a spray gun 30, is secured to the display surface 12 by a security cable 20. In the second embodiment of the present invention, the security cable 20 is secured to a male connector 32 by the stop 16 crimped on the first or distal end of the cable. In other words, a bore through connector 32 is too small to allow passage of end stop 16. The second end of the security cable 20 penetrates or extends through the connector 32 and the display surface 12. This second end is secured to the underside of the display surface by a fastening device 33 such as staples or nails. Thus the tool 30 is usefully displayed on the surface 12, may be lifted by a prospective customer, and yet is secured to the area by way of the cable 16.

These and other modifications will be readily appreciated from the foregoing without departing from the scope of the invention and applicant intends to be bound only by the claims herein.

I claim:

1. A secure pneumatic tool display apparatus for displaying pneumatic tools and comprising:

a first connector component for attachment to a pneumatic tool;

a second connector component for receiving said first connector component;

said first and second components being removably attachable to and disconnectable from each other;

said second connector component being mountable to a display structure;

a cable extending through said components; and a stop on the cable for preventing the cable from pulling out from the first connector component; and said cable being attachable to a display structure to prevent removal of the tool from the display structure, when said components are disconnected beyond a distance of the cable length.

2. Apparatus as in claim 1 further including a third connector component for securing said second connector component to said display structure.

3. A secure tool display apparatus for displaying a pneumatic tool and comprising:

a male pneumatic quick-connect fitting for attachment to a pneumatic tool;

a female pneumatic quick-connect fitting for attachment to a tool display shelf;

a cable for extending through each of said fittings, said cable having a distal end and a stop on said cable proximate said distal end for preventing said cable from pulling away from said male fitting;

said cable having another end extending outwardly from said second fitting, said other end being connectable for attachment to said display apparatus;

said female fitting being mounted on said display apparatus;

said male fitting being received within said female fitting to mount a pneumatic tool for display on said apparatus; and said male fitting being removable from said female fitting to permit manipulation of said tool;

said cable having a length sufficient to permit tool manipulation and restricting movement of said tool beyond the length of the cable from said display apparatus.

4. A secure tool display apparatus for pneumatic tools and comprising:

a first pneumatic connector fitting for attachment to a pneumatic tool;

a cable extending through said fitting;

a stop in said cable for preventing removal of said cable from said fitting when said fitting is mounted on a tool;

said cable having another portion attachable to a display apparatus for preventing removal of a tool from said display apparatus beyond the length of said cable.

5. A secure pneumatic tool display comprising:

at least one pneumatic tool;

a male pneumatic quick-connect fitting attached to said tool;

a display unit;

a female pneumatic quick-connect fitting attached to said display unit;

said male fitting being releasably receivable in said female fitting for mounting said tool for display;

a cable extending through both said fittings;

a stop proximate one end of said cable preventing cable pullout from said male fitting when said fitting is attached to a tool;

said cable having another portion attached to said display unit on an opposite side of said female fitting from said male fitting;

the length of cable between said stop and said other portion attached to said display unit being long enough to permit removal of said tool and male fitting from said female fitting and manipulation of said tool, but limiting removal of said tool by said length from said display unit.

* * * * *